US010352549B2

(12) United States Patent
Stolte et al.

(10) Patent No.: US 10,352,549 B2
(45) **Date of Patent: *Jul. 16, 2019**

(54) LED LUMINAIRE TERTIARY OPTIC SYSTEM

(71) Applicant: KENALL MANUFACTURING COMPANY, Kenosha, WI (US)

(72) Inventors: Brandon Stolte, Lindenhurst, IL (US); Kevin Dahlen, Lindenhurst, IL (US); James W. Hawkins, Lake Forest, IL (US)

(73) Assignee: KENALL MANUFACTURING COMPANY, Kenosha, WI (US)

( * ) Notice: Subject to any disclaimer, the term of this patent is extended or adjusted under 35 U.S.C. 154(b) by 140 days.

This patent is subject to a terminal disclaimer.

(21) Appl. No.: 15/706,305

(22) Filed: Sep. 15, 2017

(65) Prior Publication Data

US 2018/0003373 A1 Jan. 4, 2018

Related U.S. Application Data

(63) Continuation of application No. 14/987,310, filed on Jan. 4, 2016, which is a continuation of application (Continued)

(51) Int. Cl.

| | |
|---|---|
| ***F21V 29/77*** | (2015.01) |
| ***F21V 29/74*** | (2015.01) |
| ***F21V 3/06*** | (2018.01) |
| ***F21S 8/04*** | (2006.01) |
| ***F21V 13/00*** | (2006.01) |
| ***F21V 29/83*** | (2015.01) |

(Continued)

(52) U.S. Cl.

CPC ..... *F21V 29/777* (2015.01); *F21K 9/20* (2016.08); *F21S 8/04* (2013.01); *F21V 3/02* (2013.01); *F21V 3/062* (2018.02); *F21V 3/0625* (2018.02); *F21V 13/00* (2013.01); *F21V 29/504* (2015.01); *F21V 29/74* (2015.01); *F21V 29/83* (2015.01); *F21Y 2105/10* (2016.08); *F21Y 2115/10* (2016.08)

(58) Field of Classification Search

CPC . F21V 3/005; F21V 3/02; F21V 5/001; F21V 5/04; F21V 5/048; F21V 5/008; F21V 29/2212; F21V 29/2206; F21S 8/04; F21S 8/046

See application file for complete search history.

(56) References Cited

U.S. PATENT DOCUMENTS 4,729,076 A 3/1988 Masami et al.
4,782,435 A 11/1988 Manzoni (Continued)

OTHER PUBLICATIONS

Dialight Corporation, DuroSite_LED_Lowboy, Press Release, Apr. 5, 2011, 1 page, Dialight Website.

(Continued)

*Primary Examiner* — Robert J May
*Assistant Examiner* — Leah Simone Macchiarolo
(74) *Attorney, Agent, or Firm* — Marshall, Gerstein & Borun LLP

(57) ABSTRACT

A lens system for LED based light fixtures having a substantially coplanar array of LED's with a requirement for a wide angle of illumination. And in particular, light fixtures comprising LED lights used in low bay applications.

21 Claims, 10 Drawing Sheets

Related U.S. Application Data

No. 13/310,983, filed on Dec. 5, 2011, now Pat. No. 9,752,769, which is a continuation-in-part of application No. 13/005,288, filed on Jan. 12, 2011, now Pat. No. 8,905,589.

(51) Int. Cl.

| | |
|---|---|
| ***F21V 3/02*** | (2006.01) |
| ***F21K 9/20*** | (2016.01) |
| ***F21V 29/504*** | (2015.01) |
| *F21Y 105/10* | (2016.01) |
| *F21Y 115/10* | (2016.01) |

(56) References Cited

U.S. PATENT DOCUMENTS

| | | | |
|---|---|---|---|
| D393,093 | S | 3/1998 | Fiorato |
| D443,713 | S | 6/2001 | Benensohn |
| D464,164 | S | 10/2002 | Thompson |
| D465,599 | S | 11/2002 | Thompson |
| 6,705,747 | B2 | 3/2004 | Caferro et al. |
| D535,051 | S | 1/2007 | Stauffer |
| D571,034 | S | 6/2008 | Goetz-Schaefer |
| D583,091 | S | 12/2008 | Benensohn |
| 7,593,229 | B2 | 9/2009 | Shuy |
| 7,604,380 | B2 | 10/2009 | Burton et al. |
| 7,611,264 | B1 | 11/2009 | Chang et al. |
| D607,600 | S | 1/2010 | Keith |
| 7,682,055 | B2 | 3/2010 | Shuai et al. |
| 7,712,925 | B2 | 5/2010 | Russell |
| 7,775,692 | B2 | 8/2010 | Li |
| 7,810,965 | B2 | 10/2010 | Weaver |
| 7,828,465 | B2 | 11/2010 | Roberge et al. |
| 7,832,898 | B2 | 11/2010 | Li |
| D628,738 | S | 12/2010 | Chen |
| 7,857,497 | B2 | 12/2010 | Koike et al. |
| 7,862,210 | B2 | 1/2011 | Zhang et al. |
| 7,866,847 | B2 | 1/2011 | Zheng |
| 7,874,700 | B2 | 1/2011 | Patrick |
| D634,053 | S | 3/2011 | Guercio |
| D639,996 | S | 6/2011 | Stolte et al. |
| 7,959,329 | B2 | 6/2011 | Van De Ven |
| 7,972,036 | B1 | 7/2011 | Schach et al. |
| 7,979,197 | B2 | 7/2011 | Finn et al. |
| 8,157,422 | B2 | 4/2012 | Paik et al. |
| 8,164,237 | B2 | 4/2012 | Wen |
| 8,201,968 | B2 | 6/2012 | Maxik et al. |
| 8,226,273 | B2 | 7/2012 | Lai |
| 8,235,097 | B2 | 8/2012 | Scordino et al. |
| 8,272,765 | B2 | 9/2012 | Ter-Hovhannisyan |
| 8,430,528 | B2 | 4/2013 | Yu et al. |
| 8,672,518 | B2 | 3/2014 | Boomgaarden et al. |
| 8,905,589 | B2 | 12/2014 | Stolte et al. |
| 2007/0264492 | A1 | 11/2007 | Mizuno et al. |
| 2009/0046473 | A1 | 2/2009 | Tsai et al. |
| 2009/0296387 | A1 | 12/2009 | Reisenauer et al. |
| 2009/0296403 | A1 | 12/2009 | Zhang et al. |
| 2010/0091487 | A1 | 4/2010 | Shin |
| 2010/0124058 | A1 | 5/2010 | Miller |
| 2010/0165632 | A1* | 7/2010 | Liang ..... F21V 3/00 362/294 |
| 2010/0172143 | A1 | 7/2010 | Cunius |
| 2010/0208473 | A1 | 8/2010 | Sakai et al. |
| 2011/0110095 | A1 | 5/2011 | Li et al. |
| 2011/0133622 | A1 | 6/2011 | Mo et al. |
| 2011/0291594 | A1 | 12/2011 | Tanaka et al. |
| 2012/0217861 | A1 | 8/2012 | Soni |

OTHER PUBLICATIONS

Dialight Corporation, DuroSite_highbay_dlc, Press Release, Aug. 25, 2010, 1 page, Dialight Website.

Dialight Corporation, DuroSite, LED Low Bay Fixture, unknown publication date, 2 pages, Dialight Website.

Philips Corporation, Canlyte product brochure, unknown date, 16 pages—reference p. 7, Canlyte a Philips Group Brand, Printed in Canada.

Electromatic Products, High Light Low Energy LED Lighting, Advertising Brochure, before Dec. 20, 2010, 2 pages.

American Electric Lighting, LEDR LED Roadway, Advertising Brochure, before Dec. 20, 2010, 12 pages.

Dialight, DuroSite LED High Bay, Advertising Brochure, before Dec. 20, 2010, 8 pages.

From eurostylelighting.com, visited on Aug. 5, 2010—Murray Feiss Essentail Ceiling light; 2.) Sonneman Vienna Ceiling light; 3.) Forecast satin nickel ceiling light.

From eurostylelighting.com, visited on Aug. 5, 2010—Sonneman Vienna polished nickel 17" ceiling light.

From eurostylelighting.com, visited on Aug. 5, 2010—Forecast Presto Collection 10" wide ceiling light.

From eurostylelighting.com, visited on Aug. 5, 2010—Sonneman Trumpet 21" surface ceiling light and Sonneman Rialto 17" ceiling light.

* cited by examiner

LED LUMINAIRE TERTIARY OPTIC SYSTEM

CROSS REFERENCE TO RELATED APPLICATIONS

This is a continuation of U.S. Application No. 14/987,310, filed Jan. 4, 2016, which is a continuation of U.S. Application No. 13/130,983, filed Dec. 5, 2011, which is a continuation-in-part of U.S. Application No. 13/005,288, Jan. 12, 2011 (now U.S. Pat. No. 8,905,589), and the entire contents of each of the foregoing is expressly incorporated herein by reference.

FIELD OF THE INVENTION

The present invention relates to modular lighting systems and in particular a system for reducing glare in an LED based luminaires typically used in high output lighting structures in a low bay application.

BACKGROUND OF THE INVENTION

Light emitting diodes (LED) are an area of interest in the lighting industry due to energy savings among other desirable attributes. More and more legislation is demanding implementation of such systems to replace typical filament (incandescent) or neon based light structures.

The technology for LED based lighting systems is new and, as such, has constraints which need to be accommodated. For example, most LED luminaries utilize a design that exposes each individual LED to the user that occupies the space the luminaire is illuminating. A single LED luminaire cannot match the output of a single traditional source. Therefore LEDs are typically arranged in an array of between 30 and 200 individual LED's which comprise the acceptable luminaire output.

Each LED in the array is comprised of an electronic semi-conductor which creates an intense point of light source which is generally anisotropic, having an incident beam which disseminates in a direction perpendicular to the plane of the semiconductor substrate. This is quite different in nature than a more traditional incandescent or a florescent lamp which emits in a largely isotropic distribution of light to create what is considered a more even lighting.

LED's are expensive in relation to standard single sources. Most manufacturers have felt that they must optimize every last LED to try to minimize the cost impact and maximize the output. Optics, which can comprise lenses, diffusers, and the like; are used to more evenly distribute the light. These are seen as sources of efficiency loss through transmission loss through lenses or other optics. While this approach may outwardly seem to be the most effective manner to deploy LED luminaires, it creates a significant problem of excessive glare to an occupant directly exposed to the LEDs. Glare can also be referred to as brightness, or in lighting terms as luminance.

Luminance is a photometric measure of the luminous intensity per unit area of light traveling in a given direction. It describes the amount of light that passes through or is emitted from a particular area, and falls within a given angle. The SI unit for luminance is candela per square meter (cd/m2). Another common measurement standard is the United States Customary System (UCS) unit of measure being ft-lamberts. Regardless of units of measure, luminance is measured per unit area of light integrated over an area.

Hence, the smaller the area the brighter the surface becomes with the same amount of light transmission.

Many LED manufacturers place a first optic over the top of the bare semi-conductor to control the distribution of the light, designed to achieve a lambertian distribution which is a more even output distribution than that provided by the LED alone. Lambertian Distribution considers the sum of reflections in all directions. When a surface is composed of numerous surfaces such as a polarizer, the overall observed reflection becomes the sum of the individual reflections.

In many cases the first optic is sufficient for distributing the light. But in others, such as structure lighting, a lambertian distribution is ineffective. In these cases a secondary optic is added to the luminaire comprising a lens that is situated over each LED.

The use of second optics is a preferred methodology for achieving directionality rather than changing the primary optics which are more closely integrated into the monolithic silicon. Secondary optics can be created to work in conjunction with the specified conditions. Those skilled in the art will recognize that many combinations of primary and secondary optics can come together to create an equivalent affect, which will be henceforth referenced as a first optic configuration.

The second optic is preferably a bubble refraction design as known to those skilled in the art. The bubble refraction is highly efficient as the primary change in direction of the light is completed through a single light refraction. Additionally reflected light (light that is deflected at the optic interface and did not exit the secondary optic upon first incidence through primary refraction) can be passed through the bubble on the second, third, or even fourth reflection.

In low bay applications, such as parking garage applications, a key concern is eliminating what is known by those in the art as cave effect illumination. Cave effect is where light is distributed directly beneath the fixture while ignoring peripheral areas, creating dark corners and ceilings. Therefore the first optic configuration is directed toward a high angle refraction of the incident beam from each LED in order to create an up-light for illuminating corners and ceilings.

The primaryoptic configuration alone has shown to be insufficient for creating an aesthetically soothing light distribution suitable for low bay applications. The high intensity of the LED beam coupled with the high angle of refraction of the beam creates a disabling glare for an individual approaching such a low lighting fixture. The lighting guide for professionals (IESNA RP-20) states that the minimum light level must be no less than 1 ft-candle anywhere in the space with a uniformity of no greater than 10:1 (max to min). This means that the luminaire must have a very wide distribution to meet these requirements. This wide distribution means that a large portion of the light emitting from the secondary optic is directed at the same region at a high angle to the luminaire (a generally horizontal plane). Since an LED array comprises many LED's, every LED contributing rays of light into this relatively small high angled area, the overall effect is that the luminaire appears a number of exceedingly bright spots. The brightness can cause significant discomfort to one who views the luminaire in the main beam of light concentration. This discomfort is measured in candela/meter squared, and is quantified by measuring the exitance of light from the luminaire with relation to the angle said light is exiting from the light fixture.

To resolve this high angle brightness, a tertiary optic is added to diffuse the directional light emitted from the first optic configuration to disperse light over a much larger surface area hence reducing the perceived glare from the luminaire. In this instance, disperse can be defined as; "to cause to break up" or "to cause to be spread widely", and can comprise the mechanisms of diffusion or diffraction. Diffusion can be defined as; "to permit or cause to be spread freely" or "to break up and distribute incident light by reflection". Diffraction can be defined as: "a modification which light, in passing by the edges of opaque bodies or through narrow slits, or in being reflected from ruled surfaces and in which the rays appear to be deflected.

Adding a tertiary lens in conjunction with the first optic configuration is not straight forward because the light must be diffused or diffracted to integrate the point light sources of the LED in order to appear as a larger, more homogenous, luminary element of lower brightness or intensity than each of the point light sources (main beams) in order to reduce the glare without giving up perceived efficiency or unduly altering the distribution of light.

The lens of the present solution also comprises an element of a thermal management system to conduct waste heat away from the LED array and toward a manifold employing a passive convective heat transfer system. This improvement in heat extraction allows higher driving currents in order to optimize output of the LEDs for a given configuration. Heat generated through operation warms the surrounding air causing it to rise. This is generally referred to as free convection of a fluid. Free convection can be defined as a passive transfer of heat into a fluid (generally the air) causing differences in density of air that thereby causes the flow of air generally in an upward direction or draft. Cooler air from below rises due to the pressure differential and is channeled by a light cover, which also acts as the tertiary lens, toward a manifold where it is concentrated into a laminar flow directed toward the manifold.

Those skilled in the art will recognize that the foregoing explanation is for illustrative purposes and is not limiting in any way upon the principles taught herein. Further, in this scheme it is anticipated that the tertiary lens scheme can comprise a number of configurations. The higher the temperatures the more active the induced convective cooling becomes.

It is therefore an object of the invention to provide a passive heat transfer thermal management system for a light fixture wherein the LED covering provides a means for improved heat transfer and a tertiary optic for light diffusion.

It is therefore an object of the invention to provide a reduced glare from the light fixture.

It is another object of the invention to provide a diffusion of light coming from a high angle of incidence relative to the LED substrate.

It is another object of the invention to provide a heat transfer manifold to aid in convective heat transfer.

It is another object of the invention providing a lighting fixture suited toward low bay applications.

It is another object of the invention a lighting fixture suited toward low bay applications having sufficient up-light for illuminating a parking structure.

It is another object of the invention that this manifold structure be designed to utilize a venturi effect flow to facilitate cooling.

It is another object of the invention to provide a cooling system for inducing convective heat transfer without mechanical means.

It is another objective of the invention to provide a pleasingly aesthetic light fixture.

It is another objective of the invention to provide a lighting fixture which is low maintenance.

It is another objective of the invention that the cooling system will work with luminaires that can illuminate large open spaces and provide adequate illumination to those spaces.

BRIEF DESCRIPTION OF THE DRAWINGS

A complete understanding of the present invention may be obtained by reference to the accompanying drawings, when considered in conjunction with the subsequent, detailed description, in which.

DETAILED DESCRIPTION

Figure 1:
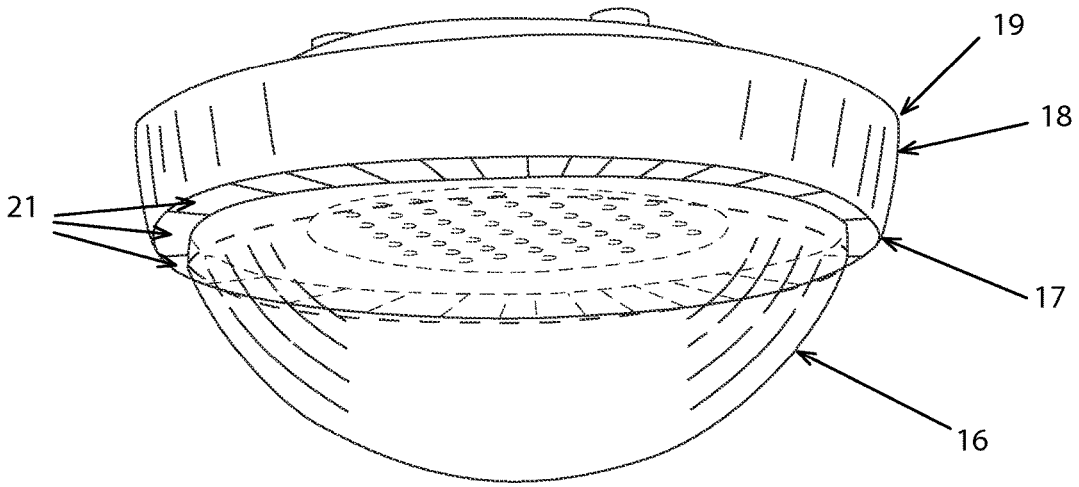
FIG. 1 is a perspective view of one embodiment of a light fixture of the present invention.
Figure 2:
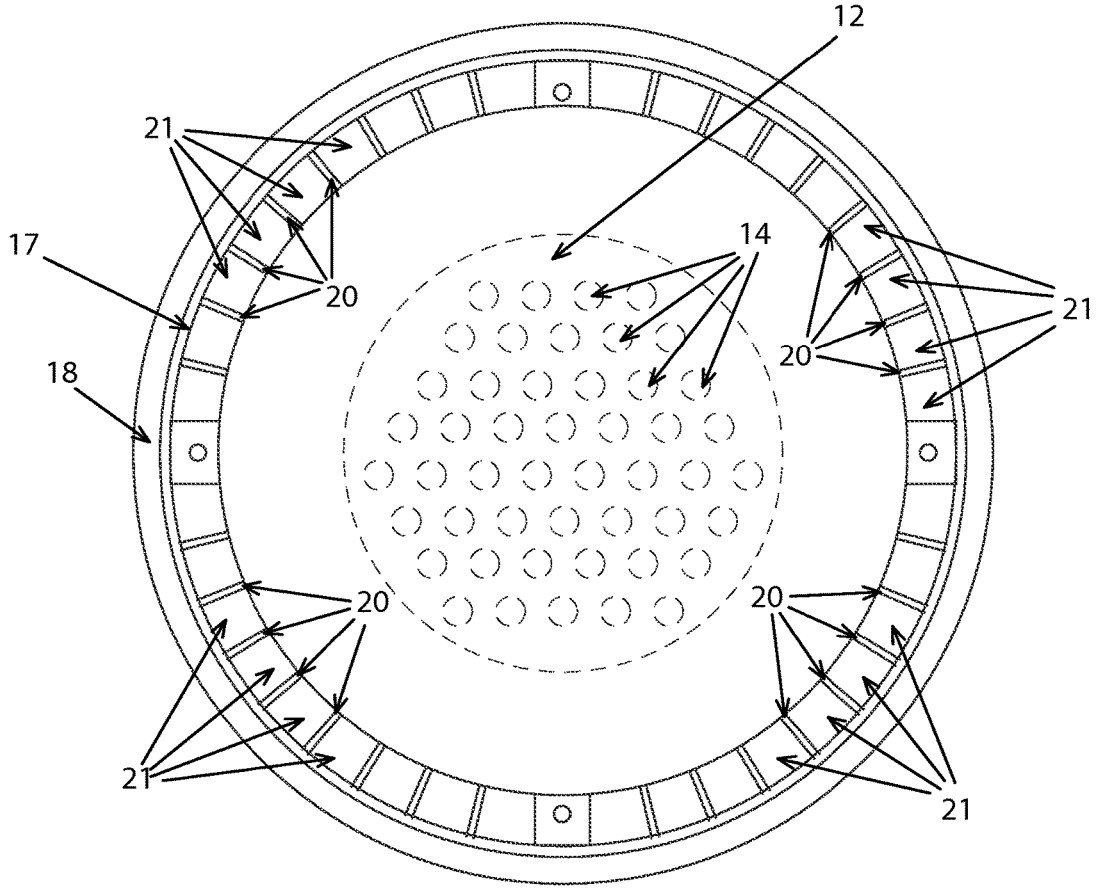
FIG. 2 is a bottom view of the present invention.
Figure 3:
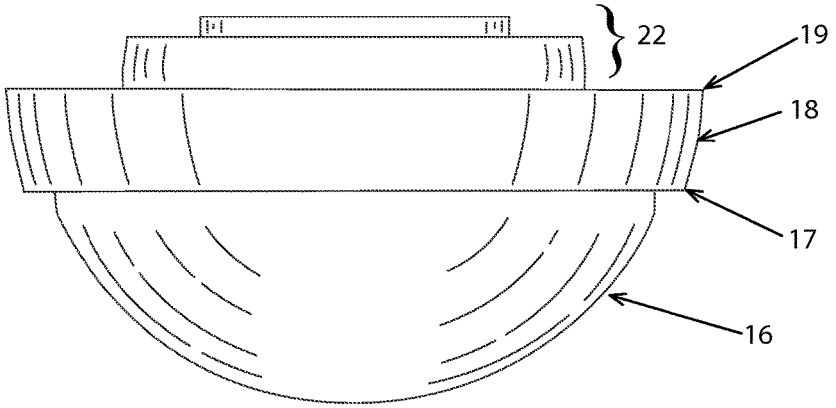
FIG. 3 is a side view of the present invention.

Referring to FIGS. 1-3, there is provided a light fixture (10) generally 14 to 20 inched in diameter, and in this case a 17 inch diameter fixture was chosen. The light fixture (10) comprises at least one light source, which in this case is generally denoted as light emitting diodes LEDs (14). In this case an array of 48 LEDs (44) was chosen. For simplicity only a few exemplary samples are pointed out. The LEDs (14) are arranged in an array (12). A mounting base (22) providing mounting structures (not shown) and power source interface and control electronics (also not shown) are provided to facilitate providing lighting from the fixture.

Additionally, two of the features, as seen from a ground perspective view, are provided in an aesthetically pleasing way. They are an array covering (16) and a skirt (18), both providing additional functionality as will be explained hereafter. The array covering (16) is generally translucent and is can also be modified to provide functionality as a focusing lens or a diffusing lens in order to better focus or distribute light from the LED array (12) and into the intended space. The covering (16) can be seen as generally inclined from a minimum point in the center of the array (12) and upward toward the skirt (18). The preferred form for the covering (16) in the example is substantially hemispherical, or saucer shaped, as this will provide laminar flow is such a way as to maximize inlet velocities and ultimately cooling capability. It is anticipated that those skilled in the art can appreciate that there are many suitable implementations of an inclined covering (12) for channeling an updraft of air. The skirt (18) forms a; rim, periphery, cincture, encasement, edging, or environs for the area encircled. In another aspect it also forms a part of the heat transfer surface area.

Figure 4:
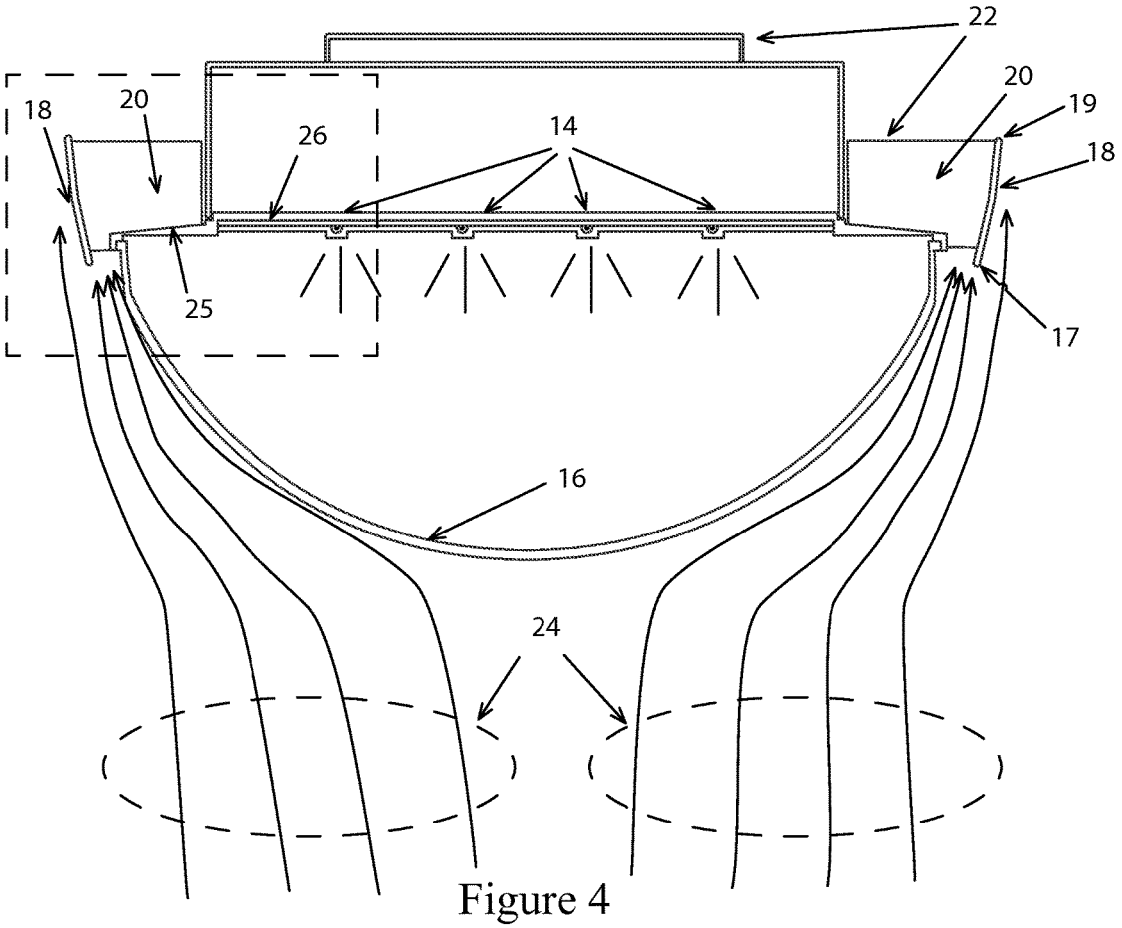
FIG. 4 is a cross-sectional view highlighting airflow patterns generated by the light fixture.
Figure 5:
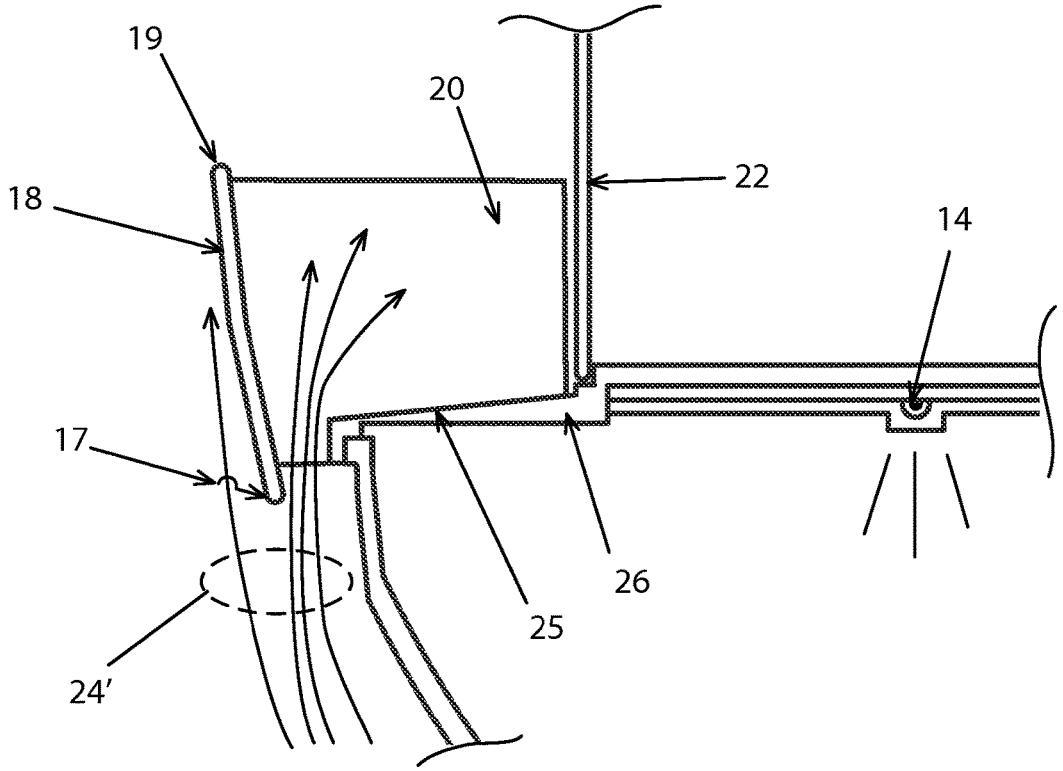
FIG. 5 is a close-up view of the light fixture of FIG. 4.

As seen in FIG. 4, heat from the LEDs (14) is conducted outward heating the thermal backplane (26), the fins (20) and the skirt (18) by means of conductive heat transfer. This heat combined with heat generated in the mounting base (22) causes an updraft of air (24) from below which is directed by the covering (16) toward a manifold structure (30) which generally comprises the skirt (18) and the fins (20). It is anticipated that the heated air will comprise a laminar flow diverging or deflecting from the center of the array covering (16) and concentrating near the inlet (24') of the manifold as seen in FIG. 5. The manifold (30) can be defined as comprising; a bottom (17), wall (18), fins (20) and thermal backplane (26) which form a series of chambers (21), roughly 32 to 40 chambers being approximately ¾ inch by 2 inches in cross section in this example. Further, the bottom (17) and wall of the skirt (18) are constricted by the edge of the thermal backplane (25) which then opens up causing a venturi effect which lowers pressure and increases flow through the chambers (21) of the manifold (30). The opening, which for present purposes is formed between the skirt (18) and the mounting base (22) and shown in FIG. 5 is an approximate seven fold expansion as seen by the cross section of a fin (20). It is also anticipated that the skirt (18) and the fins (20) can be formed as one structure of cast metal, such as cast aluminum.

Heat which is carried by the backplane (26) can be conducted either directly or through an interface (25) to the fins (20) by means of conductive heat transfer which is an efficient form of heat transfer. The venturi effect alters the boundary conditions of the convective heat transfer across the skirt (18) and the fins (20) moving the heat transfer mechanism from free convection to induced convection. It is anticipated that the heated air will generally transition to turbulent flow within the chambers (21).

Figure 6:
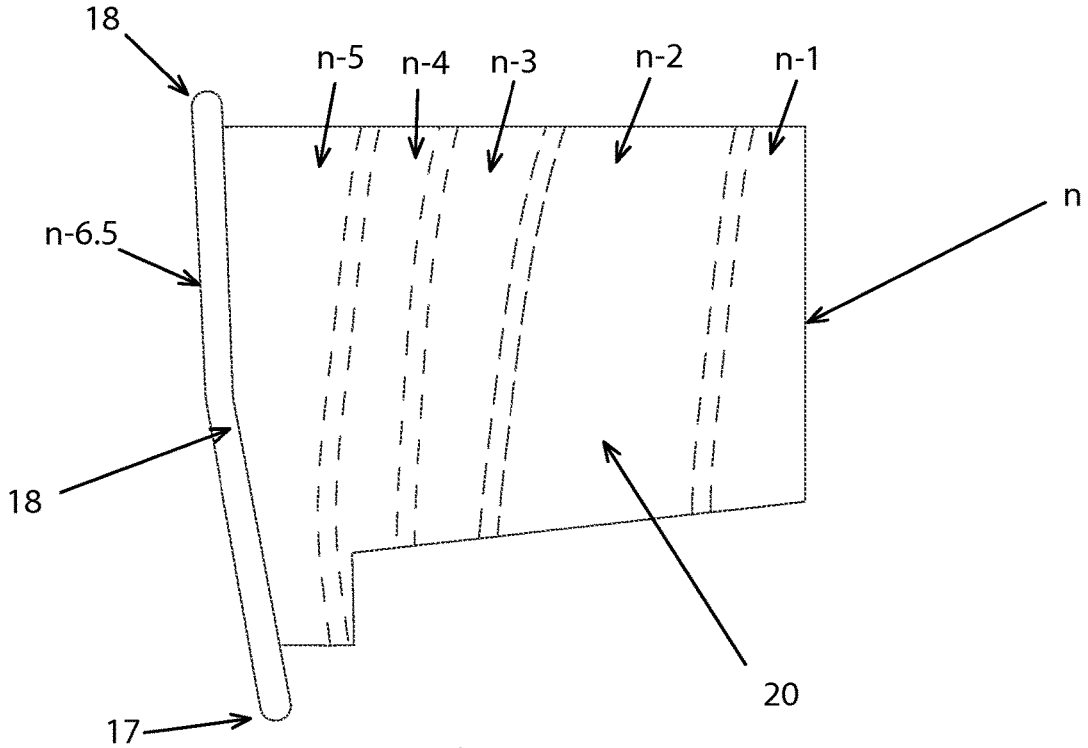
FIG. 6 is a schematic view showing exemplary temperature gradients along a fin.
Figure 7:
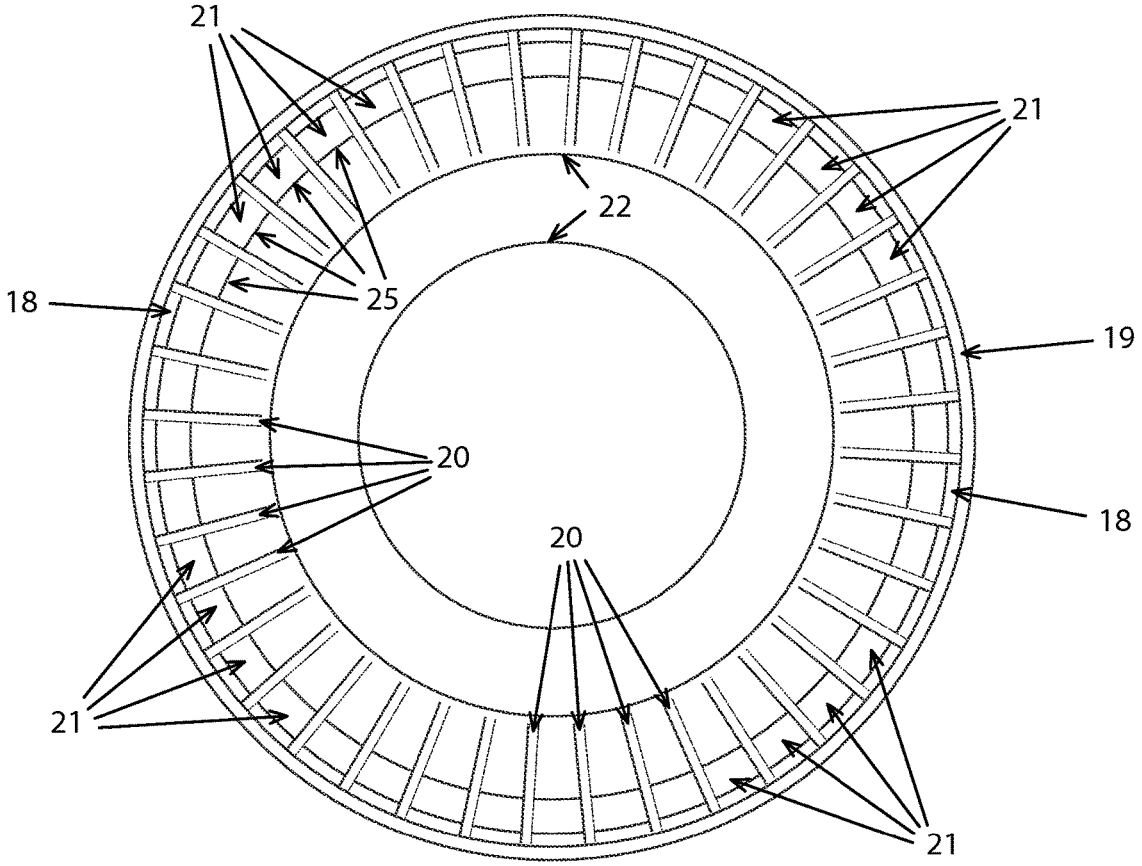
FIG. 7 is a top view of the present invention.

FIG. 6 illustrates an effective temperature gradient for one aspect of the invention. In FIG. 6, 'n' denotes a starting temperature in degrees Celsius at the proximal edge of the fin (20) and closest to the mounting base (22). Starting at "n"; and moving left, the zones; 'n-1'; 'n-2', 'n-3', 'n-4', 'n-5', and 'n-6.5' denote lower temperatures in degrees Celsius as distributed along the fin as it moved distally or radially outward. As is known by those skilled in the art of heat transfer, such temperature gradients provide a sufficient driving force for more heat to be conducted across the interface (25) thus facilitating further heat transfer. It can also be appreciated by those skilled in the art that providing a low thermally resistive path between the thermal backplane (26) and the fins (20), and if an interface (25) is used, thermal aids such as adding thermal grease or increasing the area of connection, and the like, can be added to increase the heat transfer.

Figure 8:
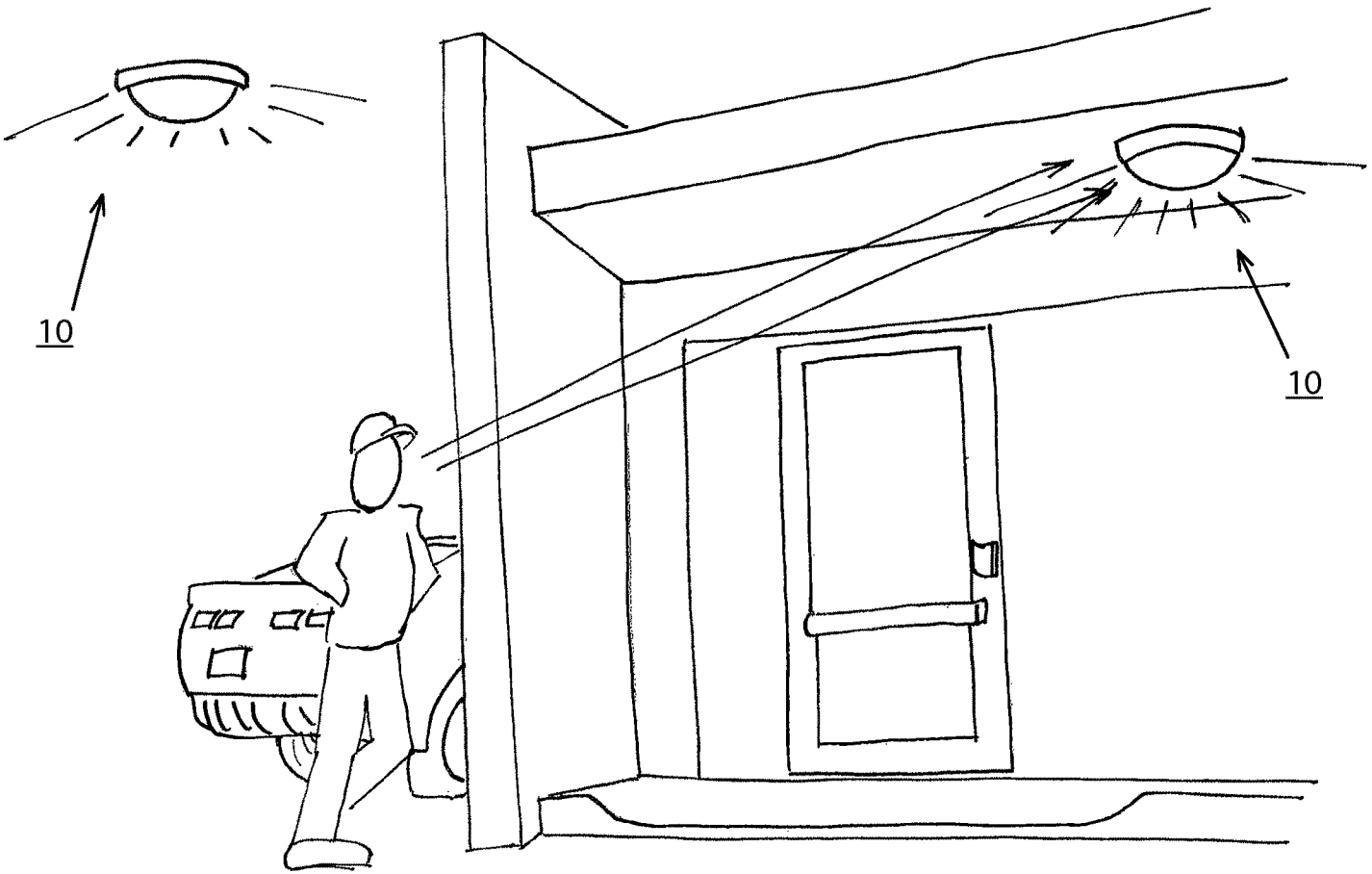
FIG. 8 is a schematic representation of a situation wherein a user may experience a high glare from a lighting fixture.
Figure 9:
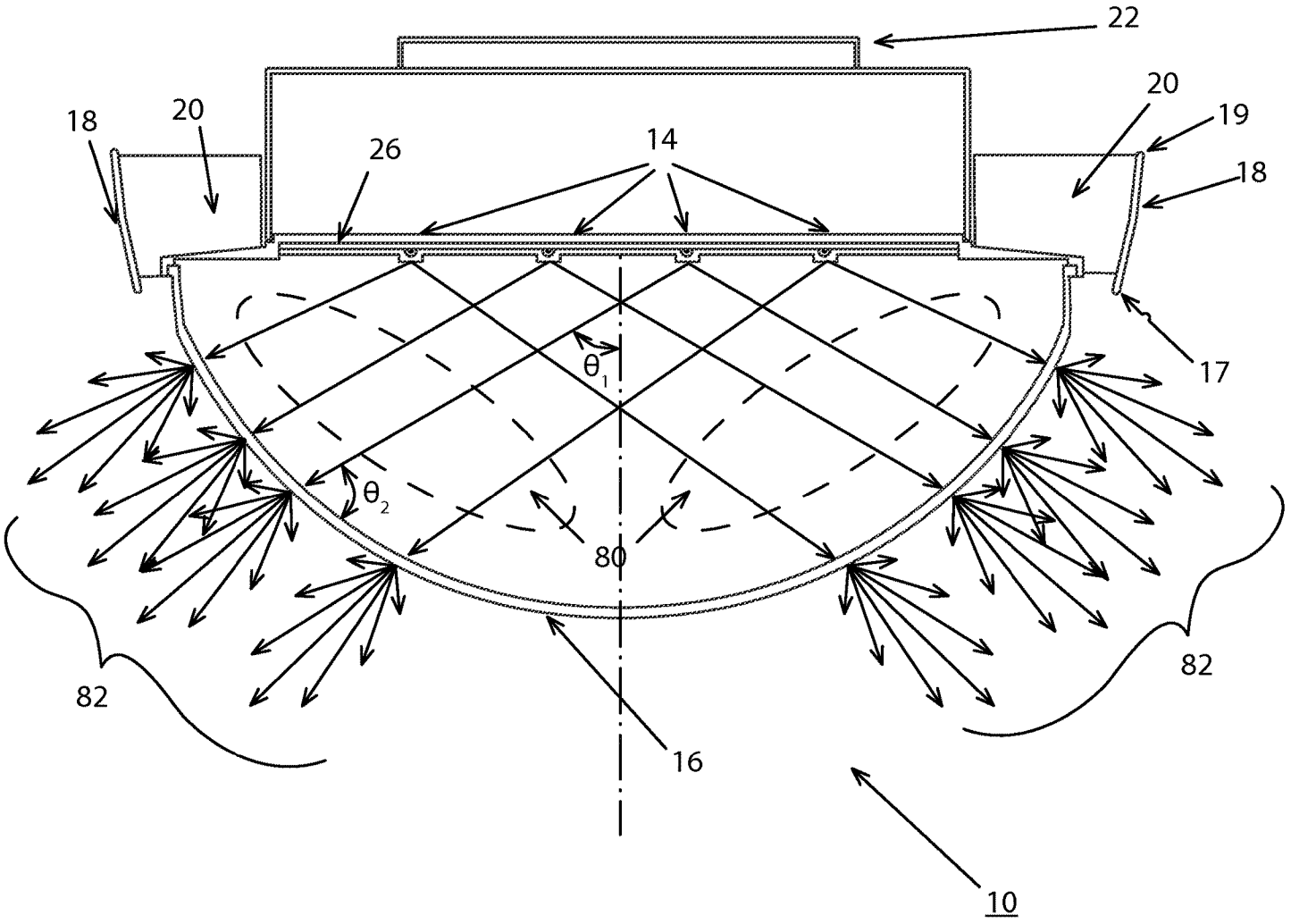
FIG. 9 is a cross-sectional view of a tertiary optic having a low profile.

FIGS. 8 and 9 illustrate conditions and principles of use where a tertiary optic is particularly effective. In individual approaches a door in a parking garage. Light fixtures (10) are located in the general parking area and in a relatively low line of sight of the viewer. An array of LED light sources (14), each generate some quantum of light. Each LED emanating rays (80) which can be seen as forming a main beam at a high incidence angle from the substrate. The incidence angle can be referenced with the backplane (26) and denoted as $\Theta_1$ between the nadir, which is substantially normal to the substrate in this instance, and the main beam of light. Ideally $\Theta_1$ is greater than 60° from the nadir to the rays (80) but can range between 50° and 80°. Each ray (80) creating an offensive glare until it reaches the lens covering (16) which forms the tertiary optic diffusing or scattering each ray (80) into a plurality of rays (82) creating a pleasing low glare illumination.

Each of the rays (80) strike the surface of the lens (16) forming an angle of refraction $\Theta_2$ between the ray (80) and a tangent to the particular point of incidence. Ideally the lens should be formed to incorporate a steep angle of refraction $\Theta_2$ preferably approaching 90°. The exiting rays (82) being highly scattered and diffused by texturing applied to the lens.

The lens should be of UV stabilized high impact resistant acrylic, polycarbonate, or like material. Dispersion through the lens can be created texturing the lens. Texturing can be formed by a mild acid etch to the mold which textures the surface of the lens through the injection molding process. Design elements should include a distance of at least two inches between the LED light source (14) and the lens (16) in order to prevent pixilation, or discernment of individual point light sources of the individual LEDs (14). Another means of creating dispersion would be to form a lens having a multiplicity of nano elements in the acrylic or polycarbonate material creating boundary layers within the injection molded lens.

Figure 10:
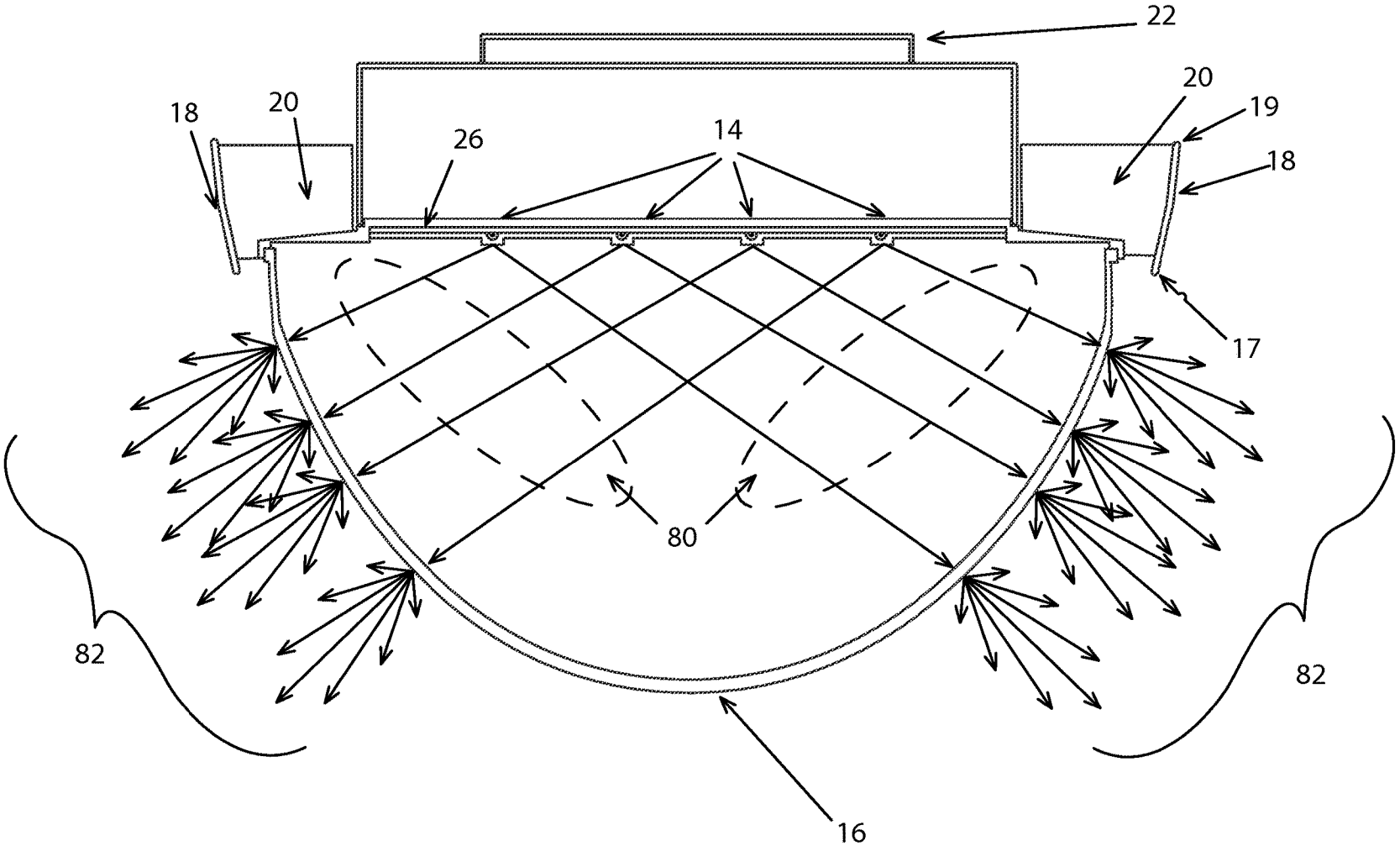
FIG. 10 is a cross-sectional view of a tertiary optic having a higher profile.

Design parameters that may be used in accordance with this methodology can include changing the depth of the lens (16A) as shown in FIG. 10. One skilled in the art would understand the trade-offs between depth of lens (16A) and the optimization of $\Theta_2$ and height requirements for low ceiling structures, also, there will be effects of the updraft for thermal reasons. These parameters can be adapted with little or no experimentation by those skilled in the art to meet the individual design requirements.

Figure 11:
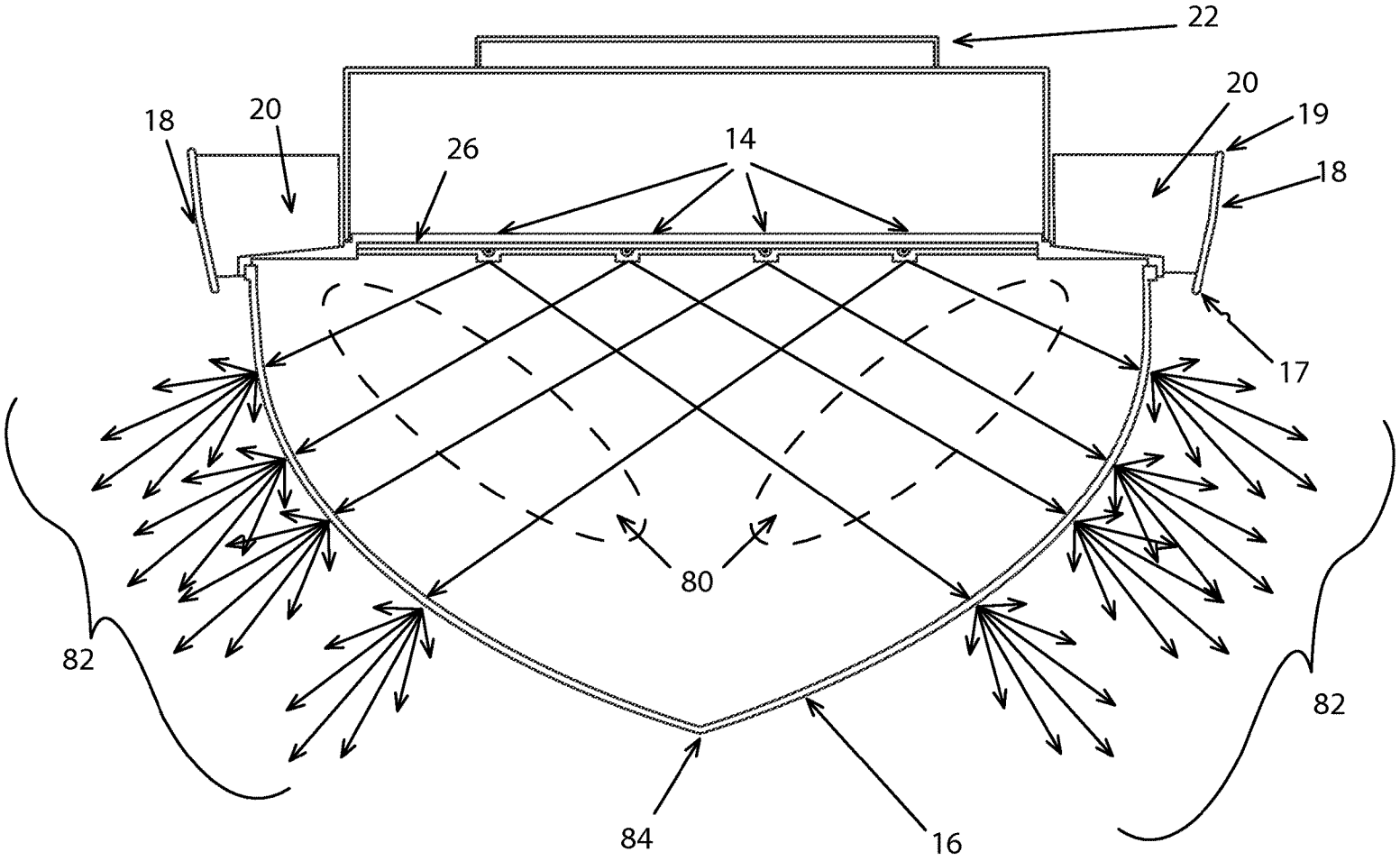
FIG. 11 is a cross-sectional view of a tertiary optic further comprising an apex design element.
Figure 12:
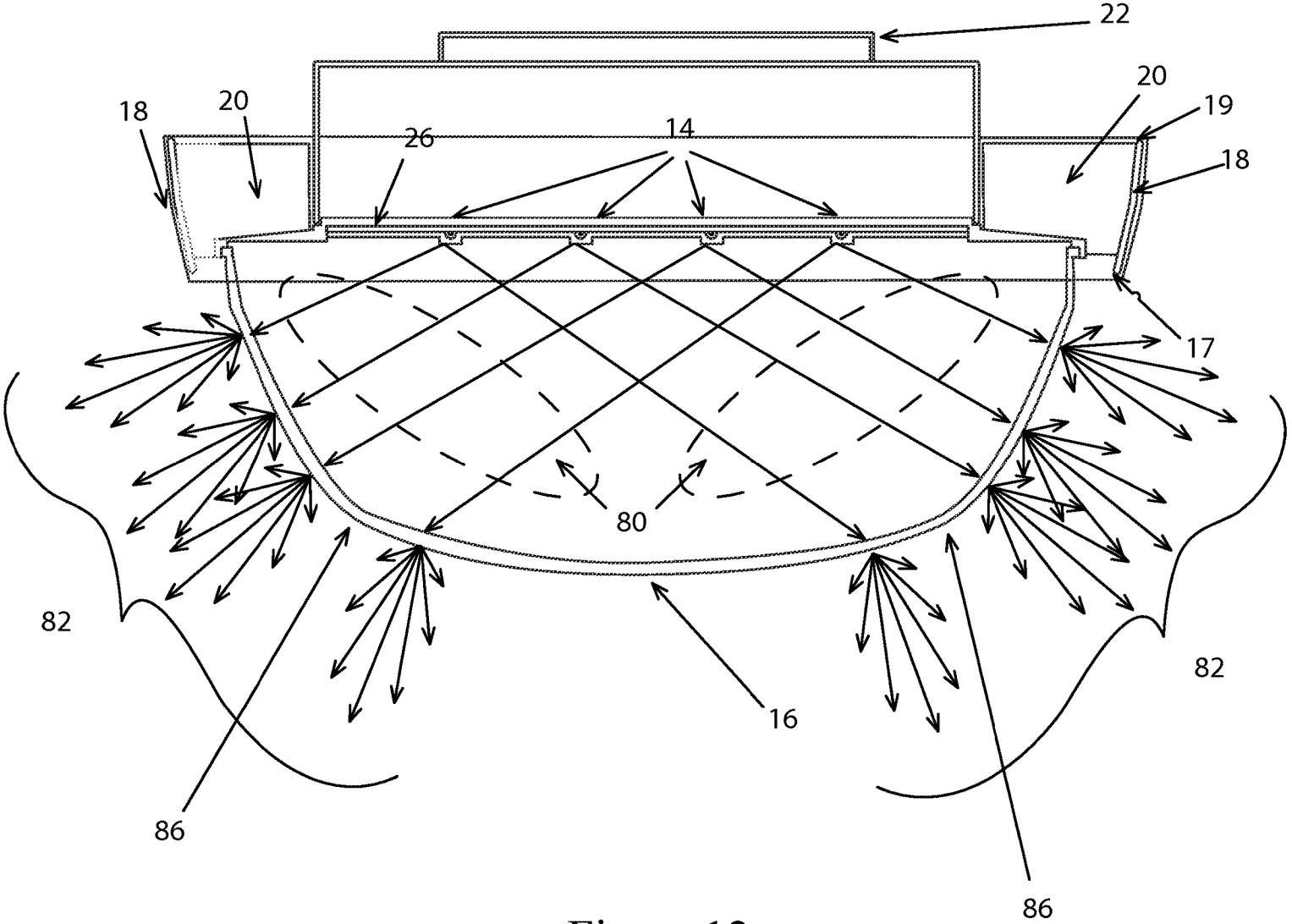
FIG. 12 is a cross-sectional view of a tertiary optic having a discontinuity in the curvature of the optic.

FIGS. 11 AND 12 illustrate various other lens designs with can accommodate the present objectives. For example; FIG. 11 depicts an apex (84) or pointed section in the formation of the lens (16B). FIG. 12 depicts a break or discontinuity (86) in the lens (16C). Each of which will bring about a different distribution of rays (82) having different illumination and visual effects. Care should be taken in design of the discontinuity (86) so as not to disrupt the laminar flow characteristics desired for the updraft of air (24).

Figure 13:
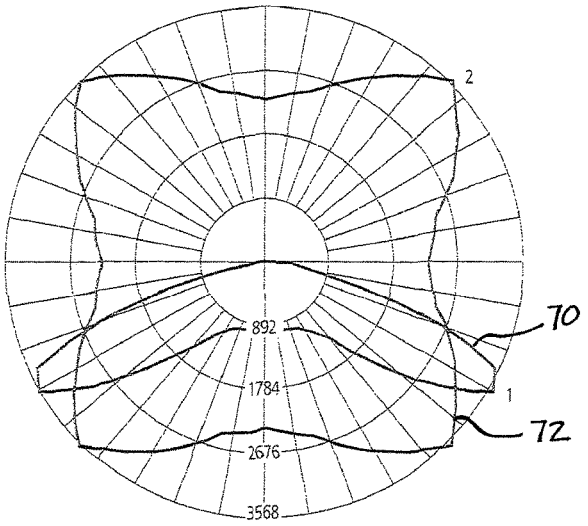
FIG. 13 is a polar distribution graph type V of a wide square lens configuration.
Figure 14:
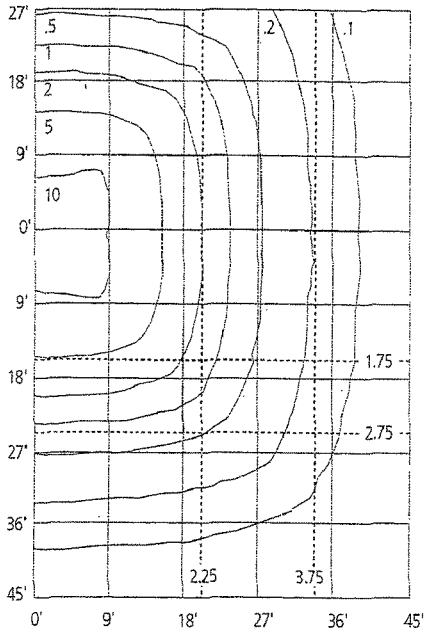
FIG. 14 is an ISO Ft-candle chart measured at 9' mounting height of a wide square lens configuration.

FIG. 13 depicts a type V wide square distribution plotted on polar coordinates for one embodiment light fixture (not shown). It is desirable to have a wide angle batwing distribution as measured via a horizontal cone (70) through vertical angle zero. A vertical plane through horizontal angles (0-180) for the embodiment is depicted in (72). FIG. 14 depicts an ISO compliant ft-candle chart generated by the present embodiment for a light fixture mounted at nine feet height above a flooring surface. Note the shape and scale depicting the light distribution across a zone of space.

Figure 15:
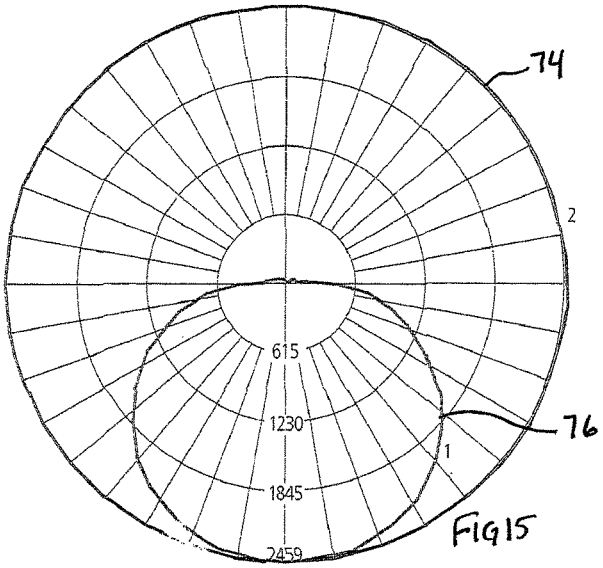
FIG. 15 is a polar distribution graph type V of a narrow round lens configuration.
Figure 16:
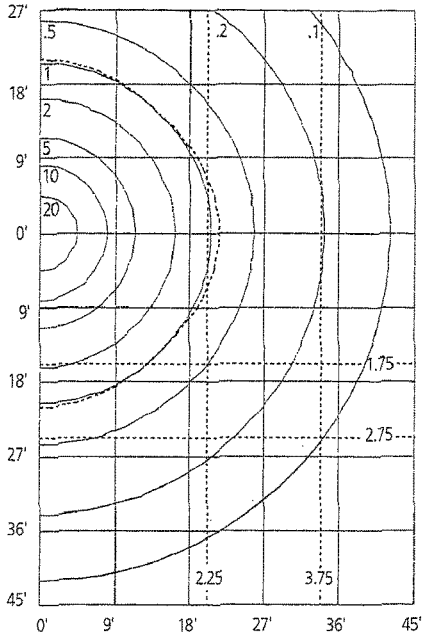
FIG. 16 is an ISO Ft-candle chart measured at 9' mounting height of a narrow round lens configuration

FIG. 15 depicts a type V narrow round distribution plotted on polar coordinates for an alternate embodiment light fixture (not shown). The corresponding horizontal cone (76) is depicted. A vertical plane through angles (0-180) for the embodiment is depicted in (74). FIG. 16 depicts an ISO compliant ft-candle chart generated by the alternate embodiment for a light fixture mounted at nine feet height above a flooring surface. Note the shape and scale depicting the light distribution across a zone of space.

CONCLUSION, RAMIFICATIONS, AND SCOPE

Although the present invention has been described in detail, those skilled in the art will understand that various changes, substitutions, and alterations herein may be made without departing from the spirit and scope of the invention in its broadest form. The invention is not considered limited to the example chosen for purposes of disclosure, and covers all changes and modifications which do not constitute departures from the true spirit and scope of this invention.

For example, although the foregoing refers to a circular perimeter lighting fixture, those skilled in the art can appreciate that polygonal, such as square, hexagon, or octagon can be utilized. In another example, the generally hemispherical array covering can also be replaced by a suitable covering having and inclined slope directed toward the perimeter of the fixture. Further, details may vary from structure to structure in terms of dimensions, scaling, and sizing of the array and fixture the exact position and type of optics deployed, depending on the physical arrangement of the structural members.

Having thus described the invention, what is desired to be protected by Letters Patent is presented in the subsequent appended claims.

We claim:

1. A light fixture having reduced glare from a light emitting diode (LED) array comprising:

(i) a generally coplanar LED array having a plurality of LEDs each LED generating a quantum of light;

(ii) a primary optic configuration receiving each quantum of light and creating a plurality of main beams of light, each main beam of light disposed at a high incidence angle relative to the LED substrate;

(iii) a refractive secondary optic configuration disposed adjacent to the primary optic configuration and receiving the plurality of main beams of light from the primary optic configuration;

(iv) a tertiary optic configuration being angularly disposed from the primary optic configuration and not immediately adjacent to the LED array and situated to receive and disperse the main beam from each LED;

(v) a treatment applied to the tertiary optic configuration, the treatment dispersing the main beam from each LED into a distributed plurality of rays collectively having a substantially batwing distribution with a type V distribution to create a larger, more homogenous luminary element with lower glare than the main beams.

2. The fixture in accordance with claim 1 wherein the angle of incidence is between 50 and 90 degrees.

3. The fixture in accordance with claim 1 wherein the distance between the LED array and the tertiary optic is greater than 2 ½inches.

4. The fixture in accordance with claim 1 wherein the mechanism for light dispersion comprises at least one of diffusion and deflection.

5. The fixture in accordance with claim 1 wherein the light fixture comprises a circular shape.

6. The fixture in accordance with claim 5 wherein the inclined cover is substantially hemispherical in shape.

7. The fixture in accordance with claim 1, wherein the treatment comprises a texturing on the tertiary optic configuration.

8. The fixture in accordance with claim 1, wherein the treatment comprises a multiplicity of nano-elements on the tertiary optic configuration.

9. The fixture in accordance with claim 1, wherein the secondary optic configuration comprises at least one lens.

10. The fixture in accordance with claim 1, wherein the type V distribution comprises a wide square distribution or a round distribution.

11. The fixture in accordance with claim 1, wherein the secondary optic configuration comprises a plurality of optics arranged in a planar configuration.

12. A method of reducing glare from a lighting fixture having an array of LEDs, the method comprising:

(i) generating a quantum of light from each of a plurality of LEDs in an LED array carried by a substantially coplanar LED substrate;

(ii) focusing each quantum of light into a main beam of light through a primary optic configuration such that each main beam of light is disposed at a high incidence angle relative to the LED substrate;

(iii) focusing each main beam of light through a refractive secondary optic configuration disposed adjacent to the primary optic configuration;

(iv) receiving each main beam of light with a tertiary optic configuration that is angularly disposed from the primary optic and is not immediately adjacent to the LED array;

(v) dispersing each main beam of light through the tertiary optic configuration and into a distributed plurality of rays with a treatment applied to the tertiary optic configuration, the plurality of rays collectively having a substantially batwing distribution with a type V distribution, thereby creating a larger, more homogenous luminary element with lower glare than the main beams.

13. The method of claim 12, wherein dispersing each main beam of light through the tertiary optic configuration comprises dispersing each main beam of light with a texturing on the tertiary optic configuration.

14. The method of claim 12, wherein dispersing each main beam of light through the tertiary optic configuration comprises dispersing each main beam of light with a multiplicity of nano-treatments on the tertiary optic configuration.

15. The method of claim 12, wherein the tertiary optic configuration causes a dispersion of light from each of the main beams.

16. The method of claim 12, wherein the batwing distribution pattern comprises at least 70% of light being directed to a zone between 50° and 70° as measured from the fixture nadir.

17. The method of claim 16, wherein the batwing distribution pattern comprises no more than 20% of the light being directed to a zone below 40° as measured from the fixture nadir.

18. The method of claim 12, wherein the batwing distribution pattern comprises no more than 5% of the light being directed to a zone above 70° as measured from the fixture nadir.

19. The method of claim 12, wherein a distance between the LED array and the tertiary optic configuration is greater than 2 ½inches.

20. The method of claim 12, wherein the tertiary optic configuration comprises an inclined cover which is substantially hemispherical.

21. The method of claim 20, wherein the inclined cover further comprises at least one of an apex or a discontinuity.

* * * * *